US007282102B2

(12) United States Patent
Choi et al.

(10) Patent No.: US 7,282,102 B2
(45) Date of Patent: Oct. 16, 2007

(54) METHOD FOR MANUFACTURING HIGH SILICON GRAIN-ORIENTED ELECTRICAL STEEL SHEET WITH SUPERIOR CORE LOSS PROPERTY

(75) Inventors: Kyu-Seung Choi, Pohang (KR); Jong-Soo Woo, Pohang (KR); Jae-Kwan Kim, Pohang (KR)

(73) Assignee: Posco (KR)

( * ) Notice: Subject to any disclaimer, the term of this patent is extended or adjusted under 35 U.S.C. 154(b) by 327 days.

(21) Appl. No.: 10/519,521

(22) PCT Filed: Nov. 11, 2003

(86) PCT No.: PCT/KR03/02413

§ 371 (c)(1),
(2), (4) Date: Dec. 23, 2004

(87) PCT Pub. No.: WO2004/044252

PCT Pub. Date: May 27, 2004

(65) Prior Publication Data

US 2005/0247374 A1 Nov. 10, 2005

(30) Foreign Application Priority Data

Nov. 11, 2002 (KR) ..... 10-2002-0069648
Nov. 27, 2002 (KR) ..... 10-2002-0074327

(51) Int. Cl.
*H01F 1/16* (2006.01)

(52) U.S. Cl. ..... 148/113; 148/110; 148/111; 148/112

(58) Field of Classification Search ..... None
See application file for complete search history.

(56) References Cited

U.S. PATENT DOCUMENTS 2,157,902 A * 5/1939 Ihrig ..... 427/190
3,224,909 A * 12/1965 Sixtus et al. ..... 148/113
3,423,253 A 1/1969 Arnes et al.
4,073,668 A 2/1978 Wieland, Jr. et al.
4,773,948 A 9/1988 Nakaoka et al.
4,904,500 A 2/1990 Krutenat
5,089,061 A 2/1992 Abe et al.
5,993,568 A * 11/1999 Takada et al. ..... 148/307
6,527,876 B2 3/2003 Namikawa et al.

FOREIGN PATENT DOCUMENTS

| | | | |
|---|---|---|---|
| EP | 0 987 341 | A1 | 3/2000 |
| JP | 56-003625 | A | 1/1981 |
| JP | 62-96615 | A | 5/1987 |
| JP | 62-103321 | A | 5/1987 |
| JP | 62-227078 | A | 10/1987 |
| JP | 05-171281 | A | 7/1993 |
| JP | 8-3723 | * | 9/1996 |
| JP | 11-315366 | * | 11/1999 |
| KR | 10-1991-0012276 | B1 | 8/1991 |
| KR | 10-1995-0014332 | B1 | 6/1995 |
| KR | 19-1997-0043180 | B1 | 7/1997 |

OTHER PUBLICATIONS

Patent Abstracts of Japan, JP62096615, published May 6, 1987, entitled "Manufacture of Grain Oriented Electrical Sheet Superior in Magnetic Characteristic and Less in Ear Cracking at Hot Rolling", Applicant: Nippon Steel Corp.

* cited by examiner

*Primary Examiner*—John P. Sheehan
(74) *Attorney, Agent, or Firm*—The Webb Law Firm, P.C.

(57) ABSTRACT

A method for manufacturing a high silicon grain-oriented electrical steel sheet. In a method for manufacturing a high silicon grain-oriented electrical steel sheet, comprising the steps of: reheating and hot-rolling a steel slab to produce a hot-rolled steel sheet; annealing the hot-rolled sheet and cold rolling the annealed steel sheet so as to adjust a thickness of the steel sheet; decarburization annealing the cold rolled steel sheet; and finish-annealing the decarburization annealed steel sheet for secondary recrystallization, the improved method further comprising the step of: coating a powder coating agent for siliconization on a surface of the decarburization annealed steel sheet in a slurry state, the powder coating agent including 100 part by weight of MgO powder and 0.5-120 part by weight of sintered powder of Fe—Si compound containing 25-70 wt % Si sintered powder, the sintered powder having a grain size of −325 mesh; drying the resultant decarburization annealed steel sheet; and finish annealing the steel sheet under a conventional condition.

8 Claims, No Drawings

METHOD FOR MANUFACTURING HIGH SILICON GRAIN-ORIENTED ELECTRICAL STEEL SHEET WITH SUPERIOR CORE LOSS PROPERTY

TECHNICAL FIELD

The present invention relates to a method for manufacturing a high silicon grain-oriented electrical steel sheet that can improve magnetic properties, especially, a core loss characteristic, and more specifically, to a method for manufacturing a high silicon grain-oriented electrical steel sheet in which a powder coating agent containing an annealing separator for siliconization is coated on the surface of a steel sheet, and finished annealed to thereby provide an electrical steel sheet with outstanding high frequency magnetic properties as well as outstanding commercial frequency properties.

BACKGROUND ART

Electrical steel sheets are generally classified into grain-oriented electrical steel sheet and non-oriented electrical steel sheet. Grain-oriented electrical steel sheet contains 3% silicon (Si) and has a texture in which grains are oriented in an orientation {(110) [001]}. Superior magnetic properties in the rolling direction allow these grain-oriented electrical steel sheet products to be used as core material of transformers, motors, generators and other electronic devices.

Recently, as electrical devices are diversified, demands on devices operating in a high frequency band have increased and thus demand for a core material with superior magnetic properties in high frequency has also increased.

In the meanwhile, in alloys of Fe—Si, since higher silicon contents allow hysteresis loss, magnetostriction, coercive force, and magnetic anisotropy among core loss properties to decrease and maximum permeability to increase, it is said that high silicon steel products are superior soft magnetic material. Then, the decrease of magnetostriction and the increase of maximum permeability do not continue limitlessly according to the increase of silicon content but show maximum values in 6.5% Si steel. Also, it is well known that magnetic properties of 6.5% Si steel reach the maximum state in high frequency band as well as commercial frequency band. Due to the superior magnetic properties in high frequency band, high silicon steel is mainly applicable to high frequency reactor for gas turbine generator, tank power supply, induction heating device, uninterruptible power supply or the like, and high frequency transformer for plating power supply, welding machine, X-ray power supply or the like, and is being used as substitution material of silicon grain-oriented steel. In addition, the high silicon steel is applicable for use to reduce power consumption of a motor and improve the efficiency of the motor.

Then, since elongation of the silicon steel sheet decreases abruptly as silicon content in Fe—Si steel increases, it is known that it is nearly impossible to manufacture the silicon steel sheet containing in excess of 3.5% Si by a cold rolling. In spite of such a fact that higher Si contents are effective in obtaining superior magnetic properties, the manufacture of such a high silicon steel sheet is recognized as a limitation of the cold rolling. Accordingly, researches on a new substitution technology that can overcome the limitation of the cold rolling are being tried from a long time ago.

Among the prior art methods for the manufacture of high silicon steel sheets, Japanese Patent Laid Open Publication No. S56-3625, discloses direct casting of a high silicon steel using a single roll or twin rolls, Japanese Patent Laid Open Publication No. S62-103321, discloses a warm rolling in which rolling is performed in a heated state at a proper temperature, and Japanese Patent Laid Open Publication No. H5-171281 discloses a clad rolling in which rolling is performed in a state wherein the high silicon steel is located at an inner portion and a low silicon steel is located at an outer portion. However, the aforementioned prior art has not yet been commercialized.

For mass production of high silicon steel products such as 3% Si non-oriented steel products, a well known process includes the steps of depositing silicon on a surface of a material by a chemical vapor deposition using $SiCl_4$ and then homogenizing the silicon, as disclosed in Japanese Patent Laid Open Publication No. S62-227078, U.S. Pat. No. 3,423,253 and the like. However, the above process causes the manufactured products to be sold inevitably at a price five times high than the conventional 3% Si steel products due to the difficulty in the CVD process. In spite of the fact that these products have superior magnetic properties, it is difficult to popularize and commercialize such products due to the high cost.

Among the currently circulated electrical steel products, only non-oriented electrical steel sheets containing 6.5% Si are produced and sold as the high silicon steel product. Owing to an irregular arrangement of grain, the non-oriented electrical steel sheets containing 6.5% Si content is used in the rotator with a small magnetic deviation according to magnetizing directions orientations. However, high silicon grain-oriented electrical steel sheet products, which demonstrate excellent characteristics in use for the transformer mainly using only the magnetic property in the rolling direction, have been not yet commercialized. Accordingly, various tries for producing a grain-oriented electrical steel sheet with superior magnetic properties due to high silicon content have been performed, but it has not been informed yet of a success to produce such products.

SUMMARY OF THE INVENTION

Accordingly, the present invention has been made in an effort to solve the above-described problems of the prior art.

An object of the invention is to provide a method for manufacturing a high silicon grain-oriented electrical steel sheet with more excellent high frequency magnetic characteristics than the conventional steel sheet by coating powder coating agent containing an annealing separator on a surface of a steel in a slurry state, and diffusion annealing the resultant steel so as to produce a high silicon steel sheet.

To achieve the above object and other advantages and in accordance with the purpose of the invention, as embodied and broadly described herein, in a method for manufacturing a high silicon grain-oriented electrical steel sheet, comprising the steps of: reheating and hot-rolling a steel slab to produce a hot-rolled steel sheet; annealing the hot-rolled sheet and cold rolling the annealed steel sheet so as to adjust a thickness of the steel sheet; decarburization annealing the cold-rolled steel sheet; and finish-annealing the decarburization annealed steel sheet for secondary recrystallization, the improved method being characterized by further comprising the steps of: coating a powder coating agent for siliconization on a surface of the decarburization annealed steel sheet in a slurry state, the powder coating agent including 100 part by weight of MgO powder and 0.5-120 part by weight of sintered powder of Fe—Si compound containing 25-70 wt % Si sintered powder, the sintered powder having a grain size of −325 mesh;

drying the resultant decarburization annealed steel sheet; and finish-annealing the steel sheet under a conventional condition.

DETAILED DESCRIPTION OF THE INVENTION

The manufacturing processes of grain-oriented electrical steel sheet differ somewhat according to manufacturers. However, each of the processes generally includes the steps of: adjusting the contents of components in the steel making process; producing a casting slab; reheating the casting slab; hot rolling the reheated casting slab; annealing the hot-rolled sheet and cold rolling the hot-rolled steel sheet so as to adjust the thickness of the steel sheet; decarburization annealing the cold-rolled steel sheet; high temperature annealing the steel sheet for a secondary recrystallization; and finish coating an insulating film on the steel sheet. The above process is based on mass production. In the mass production, it is an important factor to establish a production facility toward the cold rolling. Then, as aforementioned, higher silicon content in the electrical steel sheet decreases core loss, magnetostriction, coercive force, and magnetic anisotropy but increases maximum permeability, thereby demonstrating excellent magnetic properties. However, since the elongation that is a kind of mechanical properties abruptly decreases depending on an increase in silicon content, it is known that up to 3.3% Si is contained in a starting material to which the cold rolling enabling the mass production of electrical steel is applicable.

Accordingly, the inventors have researched processes for manufacturing high silicon electrical steel sheets by using a conventional electrical steel sheet manufacturing process employing the cold rolling, which enables mass production. As a result, the inventors have found that a grain-oriented electrical steel sheet with excellent magnetic properties can be manufactured by a process comprising the steps of: preparing slurry formed by dispersing a powder coating agent being made by mixing a sintered powder of Fe—Si group having a predetermined grain size and Si content with MgO powder as the annealing separator; coating the prepared slurry on a surface of a decarburized and nitrogen-annealed electrical steel sheet; diffusion annealing the resultant steel sheet during the high temperature annealing process to complete a high silicon content and magnetic properties by a second recrystallization, and suggests the present invention.

That is, in the present invention, in order to prevent sticking between materials while a high temperature annealing for secondary recrystallization is performed to manufacture a conventional grain-oriented electrical steel sheet, an annealing separator is inevitably coated on a surface of a steel sheet. At this time, the annealing separator is coated in a state that an Fe—Si-based sintered powder group having a predetermined grain size and Si content is added to MgO powder as main component of the annealing separator, so that a high silicon grain-oriented electrical steel sheet can be manufactured through a subsequent high temperature annealing process. In other words, the present invention provides a high silicon grain-oriented electrical steel sheet with excellent magnetic properties while employing the conventional process for manufacturing grain-oriented electrical steel sheet using the cold rolling.

First, the inventive siliconizing powder coating agent will be described in detail.

When contacting silicon (Si) with Fe metal under high temperature hydrogen or nitrogen atmosphere more than 950° C., there occurs an interdiffusion reaction where Si atoms diffuse into the Fe metal and Fe atoms diffuse into the Si containing metal making the concentration of Fe and Si in both sides identical. Accordingly, when contacting Si metal powder on a matrix portion of the electrical steel sheet and then annealing the electrical steel sheet at a high temperature, an interdiffusion reaction may be progressed by an intermovement of metal Si and matrix Fe because the concentration of the Si powder is considerably higher than the Si concentration of 3% level in the surface of the grain-oriented electrical steel sheet.

When comparing the interdiffusion reaction of Fe atoms and Si atoms, since the diffusion rate of Si atoms is faster by approximately two times than that of Fe atoms in a temperature range of 1000-1200° C., a phenomenon called the Kirkendall effect occurs, corresponding to a non-homogeneous diffusion state. This non-homogeneous diffusion state causes non-homogeneous state defects at a reaction interface or creates various compounds such as $FeSi_2$, FeSi, $Fe_5Si_3$ and $Fe_3Si$, which act as a factor deteriorating magnetic properties. Accordingly, in a case where only the metal Si powder is used as the siliconizing agent, it is in fact impossible to produce high silicon grain-oriented electrical steel sheets having a homogenous composition without surface defects through a high temperature diffusion annealing.

To solve the above problem, the inventors repeated research on the diffusion principle and so forth using Si powder and Fe powder, and finally found that the defects in the diffusion reaction portion are based on faster diffusion rate of Si than Fe.

The present invention is characterized by controlling grain size and composition of Si-containing powder agent used as the siliconizing agent so as to suppress the Si diffusion relative to the Fe diffusion. In other words, the present invention is characterized by providing an Fe—Si-based sintered powder controlled to have a predetermined grain size and composition to enable diffusion where Si atoms and Fe atoms are substituted with each other by an identical amount nearly without forming a composite compound where Fe and Si are bonded to each other at a diffusion reaction portion of the steel sheet surface, mixing the provided powder with annealing separator of MgO powder to form a mixture, and utilizing the mixture as the siliconizing coating agent.

Hereinafter, the above characteristics will be described in greater detail.

First, to further lower the diffusion rate of Si component, powder containing only Si metal is not used but Fe—Si-based compound such as $FeSi_2$, FeSi, $Fe_5Si_3$ and $Fe_3Si$, wherein Si metal is bonded to Fe metal is used as the main composition of the siliconizing coating agent.

Fe—Si-based powder used in the present invention can be manufactured by mixing Fe powder and Si powder with each other, and sintering the mixed powder at a temperature range of 1000-1200° C. in a mixture gas atmosphere of hydrogen and nitrogen for 5-10 hours, but is not necessarily restricted thereto and can be manufactured by various methods. At this time, the component ratio of the sintered powder compound is changed depending on the mixed amount of Fe powder and Si powder. Theoretically, when the mixed amount is 50% Si+50% Fe, the compound $FeSi_2$ is created, when the mixed amount is 34% Si+66% Fe, the compound FeSi is created, when the mixed amount is 25% Si+75% Fe, the compound $Fe_5Si_3$ is created, and when the mixed amount is 14% Si+86% Fe, the compound $Fe_3Si$ is created. However, in actual annealing, small amounts of several compounds may exist according to an initial mixing state. In particular, when an annealing reaction is generated by a mixing of Fe powder and Si powder, the reaction progresses in such a manner that Si atoms and Fe atoms are interdiffused to invade. Hence, although the amount of Si is somewhat large, the annealed powder reaches a state in which surfaces of the sintered powder contain most of the $FeSi_2$ compound or FeSi compound corresponding to a state that Fe atoms have been diffused exist but pure Si atoms exist at inside of the sintered powder. Accordingly, most of Fe—Si-based compound is present in the surface of the sintered powder.

In the present invention, Si content in the Fe—Si-based sintered powder obtained as above is restricted to 25-70 wt %. If the Si content is less than 25 wt %, it is so small and thus diffusion rate may be very slow. Also, the high density of the annealed powder may cause a drop of the dispersion when the coating process is performed in practice. Since the content of Si exceeding 70 wt % allows the main component to exist as $FeSi_2$ and a mixture of extra metal Si phase, the metal Si component contacts with the surface of material to increase the possibility of creating defects on the surface during the siliconizing process so that the control of the silicon content as siliconized may be difficult. In other words, by restricting the Si content contained in Fe—Si-based sintered powder to a range of 25-70 wt %, it is possible to manufacture Fe—Si-based composite compound sintered powder having $FeSi_2$, FeSi, $Fe_5Si_3$ or $Fe_3Si$ as a main component. It is more preferable that the content of $FeSi_2$+FeSi among the Fe—Si-based composite compounds should be restricted to 90 wt % or more with respect to the total weight of the sintered powder.

When Fe—Si-based sintered powder manufactured as above is mixed with MgO powder and is used as the coating agent of electrical steel sheet, this mixed powder is made in a slurry and coated on the surface of the steel sheet by using a roll coater, which is most economical in commercial production. The Fe—Si-based sintered powder as the siliconizing agent should be made as fine as possible. This enhances the coating workability in a commercial operator and is advantageous in terms of management of surface shape on the diffusion reaction. However, since the Fe—Si-based sintered powder where annealing reaction is completed is in a state of a fused lump by a high temperature and long term reaction, it is necessary to control the grain size of the powder as fine as possible.

Accordingly, the present invention requires that the grain size of the Fe—Si-based sintered powder be fine considering such a circumstance. A finer grain enhances the dispersity toward slurry state and improves the coatability. Also, by coating fine Fe—Si-based sintered powder on the surface of steel sheet, the surface contact area between the matrix material and the metal powder, i.e., interreaction area can be reduced to 30% or less compared with a single sheet contact. It is desirable that the grain size should be restricted to −325 mesh upon considering the productivity and costs for formation of fine powder.

Also, the final powder coating agent is prepared by mixing Fe—Si-based sintered powder obtained as above with MgO powder which serves as an annealing separator. Specifically, the inventive powder coating agent is prepared by mixing 100 parts by weight of MgO, which is the main component of the annealing separator, with 0.5-120 parts by weight of the Fe—Si-based sintered powder. At this time, if the added amount of the sintered powder is less than 0.5 parts, the silicon content as siliconized is few or too small. If the added. amount exceeds 120 parts, the dispersity of the sintered powder with MgO is poor, so that it is difficult to control the dispersity with MgO powder and to control the silicon content as siliconized according to the region of the matrix material, which is undesirable.

Next, a manufacturing process of a high silicon grain-oriented electrical steel sheet using the powder coating agent will be described.

As aforementioned, the invention utilizes the conventional manufacturing process of a grain-oriented electrical steel sheet including the steps of: producing a steel slab; reheating the steel slab; hot rolling the reheated steel slab; annealing the hot-rolled sheet and cold rolling the annealed steel sheet to adjust the thickness of the steel sheet; decarburization annealing the cold-rolled steel sheet; performing a high temperature annealing of the steel sheet for a secondary recrystallization; and finish coating an insulating film. However, the invention is not limited to the above concrete manufacturing process. For instance, the inventive process may omit the hot-rolled sheet annealing step, or can be applied to a manufacturing process of an electrical steel sheet including the nitrizing step together with the decarburization annealing.

The invention does not limit the initial composition of the steel slab, but it is desirable that the steel sheet to be coated with the siliconizing powder coating agent in the form of slurry contains 2.9-3.3 wt % Si. If the Si content is less than 2.9 wt %, core loss becomes severe, and if the Si content exceeds 3.3 wt %, the steel sheet is brittle so that cold rolling characteristic is very poor. More preferably, the steel sheet contains C: 0.045-0.062 wt %, Si: 2.9-3.3 wt %, Mn: 0.08-0.16 wt %, Al: 0.022-0.032 wt %, N: 0.006-0.008 wt %, remnant iron and inevitable impurity.

Considering securing the hot rolling property and the magnetic properties, the steel slab is reheated at a temperature range of 1150-1340° C., and is then hot rolled so that a hot rolled steel sheet with a thickness of 2.0-2.3 mm is made. Afterwards, hot rolled annealing is performed at a temperature below 1100° C., and pickling and cold rolling are performed to control the thickness of the steel sheet to a range of 0.20-0.30 mm that corresponds to a final thickness. In case of 0.2 mm products, twice hot rolled annealing and cold rolling are performed to control the thickness of the steel sheet to the final thickness. After that, under a moisture atmosphere containing hydrogen and nitrogen, a decarburizing and nitriding treatment is performed at an approximate temperature range of 840-890° C. to obtain a decarburized and nitrided annealed steel sheet. The aforementioned steps are well known in the conventional art, and the invention is not limited only to these above described process conditions.

The invention utilizes the decarburized steel sheet as the matrix steel sheet, which has a thin oxide layer formed on a surface thereof. Then, the thin oxide layer acts as a hindrance or barrier layer to the interdiffusion reaction during the siliconizing annealing process and functions to decrease the amount of Si atoms diffused toward the inside of the matrix steel sheet. Accordingly, this thin oxide layer may be more advantageous in manufacturing an electrical steel sheet with superior core loss characteristics.

Specifically, Fe—Si-based composite compound sintered powder is mixed with MgO powder to prepare the powder coating agent. The powder coating agent is dispersed in water and is made in a slurry. After that, the slurry coating agent is coated on the surface of the decarburized and nitrided annealed steel sheet by using a roll coater. At this time, the coating amount of the slurry coating agent is determined by the following formulas 1 and 2:

$$Y-0.25 \leqq \text{coating amount} \leqq Y+0.25 \quad \text{formula 1,}$$

and $$Y(\text{g/m}^2)=28(x1-x2)/(A-14.4)B+0.8 \quad \text{formula 2.}$$

where A is a Si content (%) in the Fe—Si-based sintered powder, B is a mixture ratio of Fe—Si-based powder contained in annealing separator composition, x1 is a target Si content (%) of matrix material, and x2 is an initial Si content of matrix material.

Thus, the steel sheet coated with the coating agent is dried and coiled in a large-sized hot rolled coil. It is desirable that the drying temperature is restricted to a temperature range of 200-700° C. If the drying temperature is less than 200° C., the drying time is too long so that productivity is lowered. If the drying temperature exceeds 700° C., oxide may be created on a surface of the steel sheet.

After that, the dried steel sheet is finish-annealed at a high temperature under a general annealing condition. In other words, the invention can use a general high temperature annealing process of a grain-oriented electrical steel sheet in which the annealing temperature is elevated up to 1200° C. under a mixture gas atmosphere of nitrogen and hydrogen, and the steel sheet is uniformly heated at 1200° C. for 20 hours or more, and then cooled.

Only to secure more superior magnetic properties by siliconizing the steel sheet coated with the powder coating agent during the finish-annealing process, it is more desirable to consider the following conditions:

First, in this general high temperature annealing process, secondary recrystallization is completed at a temperature range up to about 1100° C. Accordingly, it is more preferable to induce the Si diffusion reaction by the Fe—Si-based composite compound coating agent since 1100° C. when the magnetic properties are completed. Accordingly, it is preferable that the steel sheet is heated in an atmosphere of 100% nitrogen gas in a temperature range of from the temperature elevation start to 1100° C. to minimize the silicon content as siliconized below 0.25% if possible. In the temperature elevation process of this high temperature annealing, the content ratio of nitrogen gas among the atmosphere gases is increased to form a thin oxide on a surface of the matrix material, thereby effectively suppressing inner diffusion of Si.

Second, after 1100° C. where the secondary recrystallization is completed, it is preferable to anneal the steel sheet at a hydrogen containing atmosphere containing less than 10% nitrogen in an aspect of the control of Si content targeted to maximize the siliconizing.

By doing so, glass film starts to be formed and at the same time that secondary recrystallization is completed in a temperature elevating range up to 1100° C. of the high temperature annealing process. After that, siliconizing reaction is completed in a temperature elevating period of 1100-1200° C. and in a long term uniform heating period of 1200° C. to thereby form glass film.

Non-reacted composition remaining on the surface of the high temperature annealed steel sheet is removed by an acid solution, and then an insulation coating agent where a small amount of chroic acid is added to mixture phosophate of magnesium (Mg), aluminum (Al) and Calcium (Ca) and colloidal silica component, is coated on the steel sheet to thereby obtain high silicon grain-oriented electrical steel sheet products with maximum magnetic properties.

Hereinafter, the present invention will be described in more detail with certain presently preferred embodiments. It will be understood that the below described embodiments are in no way limiting on the scope of the present invention.

EMBODIMENT 1

Steel slabs each containing Si: 3.05% by weight, C: 0.046% by weight, P: 0.015% by weight, dissolved Al: 0.026% by weight, N: 0.0073% by weight, S: 0.005% by weight, Mn: 0.11% by weight, Cu: 0.12% by weight, remnant Fe and inevitably contained impurity were reheated at a temperature of 1190° C., then hot-rolled annealed and pickled at a temperature below 1100° C. After that, the hot rolled steel sheets were cold rolled so as to have a thickness of 0.20-0.30 mm. The steel sheet having the thickness of 0.20 mm was additively hot rolled annealed in the course of rolling so as to secure a final cold rolled rate. The cold rolled steel sheets were decarburized at an annealing temperature of 880° C. under a moisture atmosphere containing mixture gases of hydrogen and nitrogen to control the remnant carbon content and at the same time obtain decarburized annealed steel sheets each containing a total oxygen content of 610 ppm in the surface thereof.

Next, one of the obtained cold-rolled steel sheets was coated with an annealing separator formed by adding 3% $TiO_2$ powder to 100 parts by weight of MgO corresponding to the manufacturing condition of the conventional normal product, to manufacture a grain-oriented electrical steel sheet. The remaining cold-rolled steel sheets were coated with powder coating agents, which were dispersed in water and made in a slurry state and have different compositions and different grain sizes as shown in table 1, by using a roller coater. After that, these steel sheets were dried at a temperature below 700° C. and coiled to obtain large-sized coils.

The coiled grain-oriented electrical steel sheets were annealed elevating the temperature of an annealing furnace containing atmosphere gas of 40% nitrogen +60% hydrogen up to 1200° C., were uniformly heated at a temperature of 1200° C. in an atmosphere of 100% hydrogen for 25 hours and cooled. Non-reacted substances on the surface of the steel sheets are removed by hydrochloric acid, and then an insulation coating agent where a small amount of chroic acid was added to mixture phosophate of magnesium (Mg), aluminum (Al) and Calcium (Ca), and colloidal silica component, was coated on the steel sheet to form an insulation coating film, thereby manufacturing final grain-oriented electrical steel sheet products.

In the products manufactured as above, Si content and magnetic properties were examined. The magnetic properties, i.e., core loss and magnetic flux density (B8) are examined by a single sheet measuring device, and are shown in the below table 1. The coating state of annealing separator coating composition corresponds to results observed in visual inspections of appearance of coating agent. Product core loss $W_{17/50}$ represents the core loss at a frequency of 50 Hz and magnetic induction of 1.7 Tesla, $W_{10/400}$ represents the core loss at a frequency of 400 Hz, 1.0 Tesla, and $W_{5/1000}$ represents the core loss at a frequency of 1000 Hz, 0.5 Tesla, respectively. The magnetic flux density B8 represents magnetic flux per unit area, which is generated when being subject to a magnetizing force of 800 A-turn/m, and matrix Si content is a wet analysis result value.

TABLE 1

| | Fe—Si powder (as referenced by 100 part by weight of MgO) | | | | Magnetic properties | | | | |
|---|---|---|---|---|---|---|---|---|---|
| No. | Si content (%) | Grain size (mesh) | Added amount | Coating state | $B_8$ (Tesla) | $W_{17/50}$ (W/Kg) | $W_{10/400}$ (W/Kg) | $W_{5/1000}$ (W/Kg) | Si content (%) |
| 1 | — | — | 3 | Good | 1.92 | 0.90 | 7.9 | 9.3 | 3.0 |
| 2 | 15 | −325 | 40 | Thin | 1.87 | 0.86 | 7.0 | 8.5 | 3.4 |
| 3 | 35 | −325 | 40 | Good | 1.85 | 0.83 | 6.8 | 7.2 | 3.9 |
| 4 | 50 | −325 | 40 | Good | 1.85 | 0.81 | 6.6 | 7.0 | 4.2 |
| 5 | 65 | −325 | 40 | Good | 1.83 | 0.79 | 6.3 | 6.6 | 4.5 |
| 6 | 80 | −325 | 40 | Good | 1.75 | 1.56 | 12.21 | 15.34 | 5.4 |
| 7 | 100 | −325 | 40 | Thick | 1.69 | 1.98 | 17.01 | 21.17 | 5.7 |
| 8 | 60 | −150~+250 | 40 | Thin, non-uniform | 1.84 | 0.81 | 6.8 | 7.1 | 4.2 |
| 9 | 60 | −250~+325 | 40 | Thin | 1.84 | 0.80 | 6.6 | 7.0 | 4.4 |
| 10 | 60 | −450 | 40 | Good | 1.82 | 0.79 | 6.5 | 6.8 | 4.6 |
| 11 | 60 | −325 | 0.2 | Good | 1.91 | 0.90 | 7.8 | 9.2 | 3.0 |
| 12 | 60 | −325 | 70 | Good | 1.79 | 0.75 | 5.9 | 5.7 | 5.2 |
| 13 | 50 | −325 | 115 | Good | 1.83 | 0.76 | 5.9 | 6.1 | 4.8 |
| 14 | 50 | −325 | 130 | Non-uniform | 1.77 | 0.87 | 7.3 | 8.4 | 5.8 |

As seen from table 1, the inventive electrical steel sheets 3 to 5, 10, 12 and 13 manufactured using coating agent, which is prepared by mixing Fe—Si-based sintered powder configured having a predetermined grain size and composition with MgO powder were increased in Si content from 3% at an initial stage to 3.9-4.5%. In core loss $W_{10/400}$ and $W_{5/1000}$ in high frequency band as well as core loss $W_{17/50}$ in commercial frequency band, the inventive samples show superior magnetic properties having much less core loss compared with those of the conventional sample 1.

In case of the electrical steel sheet 2 containing approximately 15% Si, small coating amount and small silicon content as siliconized made the improvement in core loss small. In case of the electrical steel sheets 6 and 7 containing 85% Si and 100% Si, although coated film became thick and Si content was made high, a large amount of defects were created at the surface of the samples, so that core loss was increased. Accordingly, these samples 6 and 7 were excluded from the range of the present invention.

Also, in case of the electrical steel sheets 8 and 9 having grain sizes, which are outside the grain size range of the invention, dispersity of slurry solution is poor so that coating agent is coated thin and non-uniform. The magnetic properties after the siliconizing were comparatively good but feature values depending on regions of the material existed. Accordingly, these samples 8 and 9 were excluded from the range of the present invention.

In the meanwhile, in case of the electrical steel sheet 11 where the content of Fe—Si-based powder is small compared with that of MgO powder, siliconizing was almost not generated so that improvement in the magnetic properties was impossible. In case of the electrical steel sheet 14, slurry dispersed state was poor and coated state was non-uniform, so that magnetic properties were poor and deviation according to regions existed. So, these samples 11 and 14 were excluded from the range of the present invention.

EMBODIMENT 2

Steel slabs each containing Si: 3.20% by weight, C: 0.045% by weight, P: 0.014% by weight, dissolved Al: 0.027% by weight, N: 0.0075% by weight, S: 0.005% by weight, Mn: 0.10% by weight, Cu: 0.12% by weight, remnant Fe and inevitably contained impurity were reheated at a temperature of 1150° C., then hot-rolled annealed and pickled at a temperature below 1100° C. After that, the hot rolled steel sheets were cold rolled so as to have a final thickness of 0.23 mm. Thereafter, the cold rolled steel sheets were decarburized at the same time at an annealing temperature of 880° C. under a moisture atmosphere containing mixture gases of hydrogen and nitrogen to obtain decarburized annealed steel sheets.

Next, siliconizing composition was formed in a slurry state by mixing 25 parts by weight of Fe—Si-based sintered powder having a grain size of −325mesh and containing 50% Si with 100 parts by weight of MgO and then dispersing the mixture in water. The siliconizing composition was coated on the surfaces of the obtained decarburized annealed steel sheets by a roll coater. After that, the steel sheets were dried and coiled to obtain large-sized coils.

The coiled grain-oriented electrical steel sheets were finish-annealed so as to secure magnetic properties and siliconization due to secondary recrystallization as shown in the below table 2. Specifically, the steel sheets were subject to a heating cycle in which the temperature of an annealing furnace was elevated starting from a low temperature soaking in a temperature below 600° C. for a predetermined time period to 1200° C. in a temperature rise rate of 15° C. per hour. During the heating cycle, high temperature annealing conditions were varied as shown in table 2. In the meanwhile, in the course of the annealing, some samples at 1100° C. were extracted and an increase in Si content in the extracted samples was examined. The results are shown in the below table 2.

Non-reacted substances on the surface of the steel sheets were removed by hydrochloric acid, and then an insulation coating agent where a small amount of chroic acid was added to mixture phosophate of magnesium (Mg), aluminum (Al) and Calcium (Ca), and colloidal silica component was coated on the steel sheets to form an insulation coating film, thereby manufacturing final grain-oriented electrical steel sheet products.

In the products manufactured as above, Si content and magnetic properties were examined. The appearance state of the coating film and the standard for determining magnetic properties were evaluated under the same standard as that of embodiment 1.

TABLE 2

| | High temp annealing condition | | | | | Magnetic properties | | | |
|---|---|---|---|---|---|---|---|---|---|
| No. | Soaking temp. (° C.) | Soaking time (Hr) | Gas 1 | Gas 2 | Si, 1100° C. (%) | $B_8$ (Tesla) | $W_{17/50}$ (W/Kg) | $W_{5/1000}$ (W/Kg) | Product Si (%) |
| 1 | 400 | 20 | 100 | 0 | 0.18 | 1.77 | 0.72 | 6.4 | 4.5 |
| 2 | 500 | 15 | 100 | 0 | 0.12 | 1.78 | 0.71 | 6.5 | 4.2 |
| 3 | 450 | 12 | 100 | 0 | 0.22 | 1.77 | 0.73 | 6.4 | 4.3 |
| 4 | 450 | 12 | 100 | 10 | 0.18 | 1.76 | 0.72 | 6.3 | 4.5 |

*Gas 1: Annealed gas atmosphere up to 1100° C. is expressed by a ratio (%) of $N_2/(N_2 + H_2)$.
Gas 2: Annealed gas atmosphere of from 1100° C. to end is expressed by a ratio (%) of $N_2/(N_2 + H_2)$.

As shown in the above table 2, it is known that by more optimally controlling the high temperature annealing condition, Si content in matrix after completion of the annealing is changed to 4.2-4.5% so that the inventive steel sheets are siliconized, and superior core loss characteristics of W17/50:0.71-0.72 and W5/1000: 6.4-6.5 can be obtained.

Although the present invention has been shown and described with reference to the above preferred embodiment, it is not to be understood that the invention is limited thereto. Rather, it will be apparent to those skilled in the art that various modifications and changes may be made therein without departing from the spirit and scope of the invention as defined by the appended claims.

As described above, although utilizing the conventional general manufacturing process, the present invention can coat a siliconizing coating composition on steel sheet instead of the convetional MgO composition as an annealing separator prior to the finish high temperature annealing and siliconize the coated siliconizing coating composition to manufacture a grain-oriented electrical steel sheet having superior magnetic properties and a thickness of 0.2-0.30 mm at a low production cost.

The invention claimed is:

1. In a method for manufacturing a high silicon grain-oriented electrical steel sheet, comprising the steps of: reheating and hot-rolling a steel slab to produce a hot-rolled steel sheet; annealing the hot-rolled sheet and cold rolling the annealed steel sheet so as to adjust a thickness of the steel sheet; decarburization annealing the cold rolled steel sheet; and finish-annealing the decarburization annealed steel sheet for secondary recrystallization, the improved method further comprising the step of: coating a powder coating agent for siliconization on a surface of the decarburization annealed steel sheet in a slurry state, the powder coating agent including 100 part by weight of MgO powder and 0.5-120 part by weight of sintered powder of a Fe—Si compound containing 25-70 wt % Si, the sintered powder having a grain size of −325 mesh;

drying the resultant decarburization annealed steel sheet; and finish-annealing the steel sheet under a conventional condition.

2. The method according to claim 1, wherein the steel sheet to be coated with the powder coating agent contains 2.9-3.3 wt % Si with respect to the weight of the steel sheet.

3. The method according to claim 1, wherein the steel sheet to be coated with the powder coating agent comprising C: 0.045-0.062 wt %, Si: 2.9-3.3 wt %, Mn: 0.08-0.16 wt %, Al: 0.022-0.032 wt %, N: 0.006-0.008 wt %, remnant iron and inevitable impurity.

4. The method according to claim 1, wherein the Fe—Si-based sintered powder substantially comprises $FeSi_2$, FeSi, $Fe_5Si_3$ or $Fe_3Si$, and comprises the sintered powder of $FeSi_2$+FeSi in excess of 90 wt % with respect to the weight of the Fe—Si-based sintered powder.

5. The method according to claim 1, wherein the steel sheet coated with the slurry is dried at a temperature range of 200-700° C.

6. The method according to claim 1, wherein the dried steel sheet is heated up to a temperature of 1200° C. in a mixture gas atmosphere of nitrogen and hydrogen, and continuously uniformly heated at a temperature of 1200° C., in a 100% hydrogen atmosphere for 20 hours or more and cooled.

7. The method according to claim 1, wherein the slurry is coated on the surface of the decarburizing annealed steel sheet so as to satisfy the following formulas 1 and 2:

$$Y-0.25 \leqq \text{coated amount} \leqq Y+0.25 \qquad \text{formula 1,}$$

and $$Y(\text{g/m}^2)=28(x1-x2)/(A-14.4)B=0.8 \qquad \text{formula 2,}$$

Where A is a Si content (%) in the Fe—Si-based sintered powder, B is a mixture ratio of Fe—Si-based powder contained in annealing separator composition, x1 is a target Si content (%) of matrix material, and x2 is an initial Si content of matrix material.

8. The method according to claim 1, wherein the dried steel sheet is heated at a 100% nitrogen atmosphere in a temperature elevating period of from heating start to 1100° C. to control Si content as siliconized below 0.25%, and is then heated in an atmosphere containing less than 10% nitrogen after 1100° C. where the secondary recrystallization is completed.

* * * * *

UNITED STATES PATENT AND TRADEMARK OFFICE

CERTIFICATE OF CORRECTION

PATENT NO. : 7,282,102 B2
APPLICATION NO. : 10/519521
DATED : October 16, 2007
INVENTOR(S) : Choi et al.

It is certified that error appears in the above-identified patent and that said Letters Patent is hereby corrected as shown below:

Column 5, line 42, “commercial operator” should read -- commercial operation --

Column 6, line 23, “the nitrizing step” should read -- the nitriding step --

Signed and Sealed this

Twenty-ninth Day of April, 2008

JON W. DUDAS
*Director of the United States Patent and Trademark Office*